US009238951B2

(12) United States Patent
Woods

(10) Patent No.: US 9,238,951 B2
(45) Date of Patent: Jan. 19, 2016

(54) POLISH ROD SEAL

(75) Inventor: Pete A. Woods, Chester, MT (US)

(73) Assignee: Woods Petroleum LLC, Chester, MT (US)

( * ) Notice: Subject to any disclaimer, the term of this patent is extended or adjusted under 35 U.S.C. 154(b) by 721 days.

(21) Appl. No.: 13/449,223

(22) Filed: Apr. 17, 2012

(65) Prior Publication Data

US 2013/0269927 A1 Oct. 17, 2013

(51) Int. Cl.
*E21B 33/08* (2006.01)

(52) U.S. Cl.
CPC ..... *E21B 33/08* (2013.01)

(58) Field of Classification Search
CPC ..... E21B 33/08; E21B 33/085; E21B 33/04; E21B 33/06; E21B 21/02
USPC ..... 166/84.2, 84.1
See application file for complete search history.

(56) References Cited

U.S. PATENT DOCUMENTS

| | | | | | |
|---|---|---|---|---|---|
| 3,244,424 | A | * | 4/1966 | Cope | 277/323 |
| 3,468,374 | A | * | 9/1969 | Reeves | 166/84.2 |
| 3,939,910 | A | | 2/1976 | Bruce | |
| 4,179,856 | A | * | 12/1979 | Wheeler | 451/439 |
| 4,345,766 | A | | 8/1982 | Turanyi | |
| 4,530,397 | A | | 7/1985 | Calhoun | |
| 4,613,140 | A | | 9/1986 | Knox | |
| 4,889,184 | A | * | 12/1989 | Lugtmeier et al. | 166/84.1 |
| 5,058,668 | A | | 10/1991 | Newton | |
| 5,217,068 | A | | 6/1993 | Newton | |
| 5,577,737 | A | | 11/1996 | Lacy | |
| 6,412,783 | B1 | | 7/2002 | Finnestad | |
| 7,284,602 | B2 | | 10/2007 | Tessier et al. | |
| 7,931,078 | B2 | | 4/2011 | Toporowski et al. | |
| 2006/0272804 | A1 | | 12/2006 | Tessier et al. | |
| 2009/0211750 | A1 | | 8/2009 | Toporowski et al. | |

* cited by examiner

*Primary Examiner* — Blake Michener
*Assistant Examiner* — Wei Wang
(74) *Attorney, Agent, or Firm* — Antoinette M. Tease

(57) ABSTRACT

A polish rod seal comprising: a post with a bottom end, top part, and circumferential flange situated between the bottom end and top part; a collar that fits over the top part of the post, the collar having one or more internal channels into which O-rings are inserted and positioned between the collar and top part of the post; and a barrel with a bottom end and two internal bushings, each of which has one or more internal channels into which O-rings are inserted. The bottom end of the barrel screws into the top part of the post. A bracket is attached to the circumferential flange and secures the collar on the top part of the post while still allowing it to flex on the post. A polish rod extends through the post, collar and barrel and is in contact with the O-rings in the internal bushings.

6 Claims, 10 Drawing Sheets

POLISH ROD SEAL

BACKGROUND OF THE INVENTION

1. Field of the Invention

The present invention relates generally to oil field equipment, and more specifically, to a maintenance-free seal for the polish rod of a reciprocating oil well pump.

2. Description of the Related Art

In the oil field industry, the polish rod is the uppermost joint in the string of sucker rods used in a rod pump reciprocal lift system. The purpose of the polish rod is to create an efficient hydraulic seal around the reciprocating rod string. [1] Stuffing boxes, such as those manufactured by Hercules Tool Company and Skinner Brothers Co., Inc., both of Tulsa, Okla., are typically used on polish rods to prevent oil from leaking out of the system. Due to the high pressures of fluid (oil) in the well and the speed at which the rod strings reciprocate, wear and tear on the stuffing boxes is common. Most stuffing boxes are fixed solid to the wellhead tee and do not allow for any flexibility in the pumping unit. The polish rod, however, will flex slightly right and left (laterally) during operation, and this lateral movement causes the packing inside of the stuffing boxes to eventually fail. Thus, either the packing or the stuffing boxes themselves must be periodically replaced. Failure to replace the packing in a timely manner can have catastrophic—and expensive—consequences for the well operator.

Yet another problem with existing stuffing box designs is that when the well is in pump-off mode, it is not moving fluid; therefore, no fluid is present in the stuffing box to lubricate the packing or cool the polish rod. When this happens, the polish rod becomes warm (sometimes hot) and dry. It rubs through the packing rubber, which gets hot and sticky, causing the packing to wear out. Factors affecting how quickly the packing wears out and begins to leak production fluid include: how straight the polish rod is; how long the stroke of the pumping unit is; how fast the unit is pumping; and how straight the pump jack is.

The third problem associated with existing stuffing boxes is that they typically need to be insulated during cold weather to prevent freeze-ups. The stuffing boxes need to be tightened periodically as the packing wears out, but the insulation makes the stuffing box difficult to access, and it also prohibits visual inspection by the pump operator. The present invention makes it more convenient to insulate because no adjustment of the packing is necessary (there is no packing).

The present invention overcomes the disadvantages of prior art stuffing boxes by replacing the stuffing box altogether with a polish rod seal that is specifically designed to accommodate slight lateral movement of the polish rod while still allowing it to accomplish its function. The present invention incorporates a fluid reservoir that prevents the polish rod from over-heating. In addition, the present invention does not utilize nor require packing and is essentially maintenance-free. None of the prior art inventions discussed below solves the same problem in the same manner as the present invention, which is described more fully below in the Detailed Description of Invention section.

U.S. Pat. No. 3,939,910 (Bruce, 1976) provides a stuffing box and blow-out preventing device for polish rods of oil well pumping units. The invention comprises a cylindrical tube with a screw-threaded packing gland in the upper end. An upper guide rubber (i.e., packing) with a plurality of packing rubbers attached above it is engaged by the gland, which applies pressure to seal the polish rod reciprocating within the stuffing box. More specifically, a packing gland nut screw compresses the packing elements relative to the upper wide rubber and polish rod. A blow-out preventor assembly is situated below the upper guide rubber, and O-rings are used to seal the cylindrical rubber portion of the blow-out preventor against the polish rod. An annular chamber is on the outer surface of the cylindrical rubber and is in communication with a source of pressurized fluid. The pressurized fluid is used to apply pressure to the cylindrical rubber portion surrounding the polish rod to shut off the well, and it also acts as an automatic blow-out preventor in the event the polish rod breaks.

U.S. Pat. No. 4,345,766 (Turanyi, 1982) discloses an apparatus for sealing an oil well pump polished rod. The apparatus comprises a tubular housing with two operating tubular portions that are connected to enable limited angular movement between them but also resiliently urged by guide bushings to maintain longitudinal alignment. A plurality of longitudinally spaced packing rings in one of the two housing portions form a seal around the polished rod. Upper and lower rod scrapers protect the seals from coming into contact with any undesired foreign matter that may be carried by the polished rod.

U.S. Pat. No. 4,530,397 (Calhoun, 1985) provides an oil-saving apparatus for use with an oil pump polish rod that attaches to the stuffing box surface. Thus, this invention is intended to be used with a stuffing box, not in lieu of it. The apparatus comprises a housing that attaches to the surface of the stuffing box from which the polish rod emerges. The housing surrounds the polish rod and has an internal collection chamber and an internal packing chamber with auxiliary packing. This invention is intended to collect any fluid that leaks from the stuffing box, but it does not attempt to prevent such leaks.

U.S. Pat. No. 4,613,140 (Knox, 1986) discloses a self-aligning lubricating stuffing box for oil well polish rods. The apparatus comprises a housing situated around the outer periphery of the polish rod with an internal cooling chamber for retaining a fluid reservoir in contact with the polish rod. The apparatus further comprises two bushings (24 and 52 in FIG. 2) that are longitudinally offset from one another and that maintain the polish rod in lateral (axial) alignment. The invention includes a swivel mechanism to compensate for any misalignment between the pump jack and the pumping "T."

U.S. Pat. No. 5,058,668 (Newton, 1991) provides a rod guide bearing assembly for an oil well pumping apparatus. The invention is a stuffing box assembly comprising a pair of axially spaced bearing assemblies and packing coils positioned between rod guide members at either end of the assembly. Compressive forces are applied to compress the packing coils. Each rod guide member has a liner portion that occupies an annular space between the stuffing box and the polished rod so as to retain axial alignment of the polish rod as it reciprocates. Scraper rings located in internal grooves on the bottom end of the assembly act as the primary seal and also remove scale build-up on the polished rod.

U.S. Pat. No. 5,217,068 (Newton, 1993) discloses an improved stuffing box for a rotary well. The stuffing box comprises upper and lower rod guides with annular packing elements in between them. The lower guide rod is an annular bushing with interior sealing elements at each end of the bushing to form a seal between the bushing and the polished rod. An annular exterior sealing element (O-ring) is situated on the external surface of the bushing (lower rod guide) to form a seal between the bushing and the interior surface of the housing. The invention utilizes a compressive force on the annular packing elements to force them into engagement with the external surface of the polished rod.

U.S. Pat. No. 5,577,737 (Lacy, 1996) provides a method and apparatus for establishing and maintaining a fluid seal around a polishing rod. The invention comprises a fluid responsive gland that forms a seal between the polished rod and the inner surface of the housing. The fluid responsive gland is comprised of packing rings made of supple and rigid materials in alternating configurations. The fluid responsive gland is compressed to maintain engagement with the polished rod. It is comprised of a first self-alignment bushing with an L-shaped cross-section, a second self-alignment bushing with an L-shaped cross-section, and a plurality of V-shaped (chevron) packing rings stacked between the first and second self-alignment bushings.

U.S. Pat. No. 6,412,783 (Finnestad, 2002) discloses a self-aligning stuffing box for pump jacks. The invention comprises a first tubular body having an interior bore with internal stops and a second tubular body having a first end with a concave contact surface. The second tubular body fits telescopically into the first tubular body and is prevented from being withdrawn by virtue of the engagement of the concave contact surface of the second tubular body with the internal stops of the first tubular body. An Annular body with a convex contact surface fits inside of the first tubular body and engages with the concave contact surface of the second tubular body. A third tubular body fits within the first tubular body and exerts a compressive force upon the annular body to ensure that the convex contact surface of the annular body and the concave contact surface of the second tubular body maintain their engagement with one another. This invention has at least five places where the various parts are in threaded engagement with one another. The invention further comprises a tubular packing housing that defines a packing chamber that is adapted to receive packing. The convex surface of the annular body is allowed to move relative to the concave surface of the second tubular body to compensate for misalignment in response to vibration of the polished rod within the axial bore, thereby reducing the rate of wear and tear on the packing and polished rod.

U.S. Pat. No. 7,284,602 (Tessier et al., 2007) provides a self-aligning stuffing box with a spherical joint between the upper and lower portions of the housing that permits the upper and lower portions to move relative to each other in the event that the axis of the polish rod is misaligned. The lower end of the upper housing has a lower concave spherical surface that is upwardly recessed, and the lower housing has an upwardly extending substantially convex spherical surface with a central recess for accepting a downwardly depending central portion of the upper tubular housing and permitting engagement of the concave and convex spherical surfaces. Once engaged, the upper housing is capable of limited universal movement relative to the lower tubular housing. A first sealing means is housed within the downwardly depending central portion of the upper housing and is preferably comprised of a plurality of stacked circumferential chevron seals. A second sealing means is housed in a bore in the upper tubular housing.

U.S. Pat. No. 7,931,078 (Toporowski et al., 2011) discloses a stuffing box apparatus comprising a tubular housing with a bore through it for the polish rod and sealing members situated in the bore in an upper stack and a lower stack. The upper and lower stacks of sealing members are separated by an intermediate bushing. The upper stack is compressed against the intermediate bushing by an upper bushing, and the lower bushing secures the lower stack of sealing members against the bottom of the intermediate bushing. Wiper members form a seal between each bushing and the polish rod.

BRIEF SUMMARY OF THE INVENTION

The present invention is a polish rod seal comprising a post comprising a bottom end, a top part, and a circumferential flange situated between the bottom end and the top part; a collar that fits over the top part of the post, wherein the collar comprises one or more internal channels into which one or more O-rings are inserted, and wherein the O-rings are positioned between the collar and the top part of the post; a barrel comprising a bottom end and two internal bushings, each of which comprises one or more internal channels into which one or more O-rings are inserted; wherein the bottom end of the barrel screws into the top part of the post; and a bracket that is attached to the circumferential flange and that secures the collar on the top part of the post while still allowing it to flex on the post; wherein a polish rod extends through the post, the collar and the barrel and is in contact with the O-rings in the internal bushings of the barrel.

In a preferred embodiment, the barrel further comprises a top end, one of the two internal bushings is located in the top end of the barrel, the other of the two internal bushings is located in the bottom end of the barrel, there is a cavity between the two internal bushings inside of the barrel, and this cavity acts as an internal fluid reservoir for lubricating the bushings. O-rings in the channels in the internal bushings, and polish rod and for cooling the polish rod. Preferably, the O-rings in the internal bushing in the bottom end of the barrel are closer together and more numerous than the O-rings in the internal bushing in the top end of the barrel.

In a preferred embodiment, the barrel comprises two apertures that are longitudinally offset from one another; one aperture acts as an inlet for adding fluid to the internal fluid reservoir, and the other aperture acts as an outlet for draining fluid in the internal fluid reservoir. Preferably, the barrel further comprises a top end, and the invention further comprises a top cap that is attached to the top end of the barrel. The top cap has an inside bore with a perimeter, and the top cap preferably comprises a dust seal that is situated around the perimeter of the inside bore of the top cap.

In a preferred embodiment, the collar comprises a top edge, and the bracket comprises: a top circumferential portion that surrounds the barrel and is situated on top of the top edge of the collar; and two vertical extensions that extend downward from opposite sides of the top circumferential portion and that end in two bottom protrusions that are secured to the circumferential flange of the post.

REFERENCE NUMBERS

Figure 1:
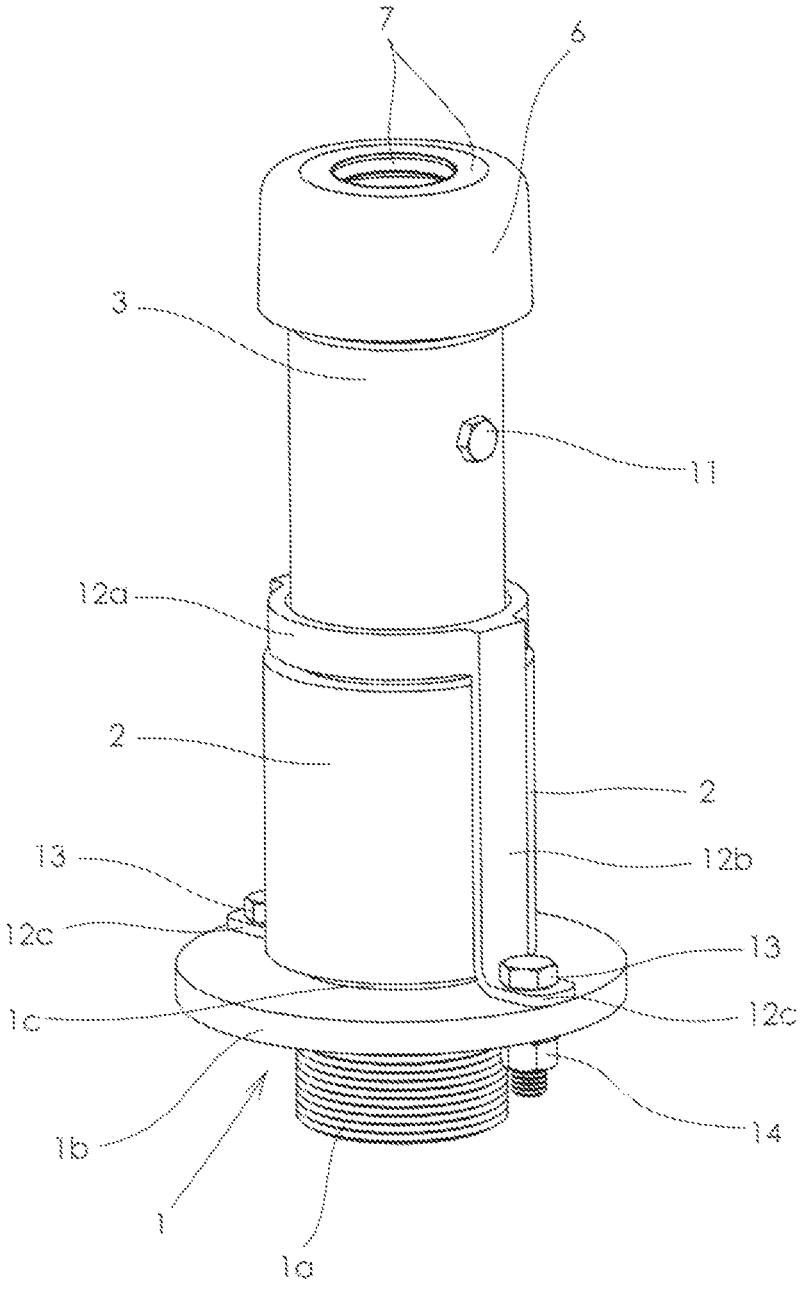
FIG. 1 is a perspective view of the present invention in a fully assembled state.

1 Post
1*a* Bottom end (of post)
1*b* Circumferential flange (of post)
1*c* Top part (of post)
1*d* Aperture (in circumferential flange)
1*e* Top edge (of post)
2 Collar
2*a* Top edge (of collar)
2*b* Inner top threaded portion (of collar)
2*c* Inner bottom non-threaded portion (of collar)
2*d* Bottom edge (of inner top threaded portion of collar)
2*e* Channel (in collar)
3 Barrel
3*a* Bottom end (of barrel)
3*b* Top end (of barrel)
3*c* Aperture (in barrel)
4 Top bushing
4*a* Channel (in top bushing)
5 Bottom bushing
5*a* Channel (in bottom bushing)
6 Top cap
7 Dust seal
7*a* Dust seal spring
8 O-ring (in top and bottom bushings)
9 O-ring (between post and collar)
10 Polish rod
11 Plug
12 Bracket
12*a* Top circumferential portion (of bracket)
12*b* Vertical extension (of bracket)
12*c* Bottom protrusion (of bracket)
13 Bolt
14 Nut
15 Washer
16 Lubrication tube
17 Drain tube
18 Top cap assembly
19 Barrel assembly
20 Collar assembly
21 Fluid reservoir

DETAILED DESCRIPTION OF INVENTION

FIG. 1 is a perspective view of the present invention in a fully assembled state. As shown in this figure, the present invention comprises a post 1, a collar 2, a barrel 3, a top cap 6, and a bracket 12. The bottom end of the post 1 (which is preferably threaded) is secured to the wellhead tee (not shown). The polish rod 10 (see FIG. 7) moves up and down inside the polish rod seal as the reciprocating rod string moves up and down in the wellhead. The post 1 comprises a threaded bottom end 1*a* (the bottom end 1*a* is only threaded on the outside), a circumferential flange 1*b*, and a non-threaded top part 1*c*. The post 1 has a continuous and non-threaded bore through the center of it (see FIGS. 2, 6, and 8-11).

The circumferential flange 1*b* of the post 1 comprises two apertures 1*d* through which bolts 13 are inserted and secured with nuts 14. These two bolts 13 also pass through the two bottom protrusions 12*c* of the bracket 12. The bracket 12 comprises a top circumferential portion 12*a* that surrounds the barrel 3 when it is screwed into the collar 2. When the invention is fully assembled, the top circumferential portion 12*a* of the bracket 12 also lies directly on top of the top edge 2*a* (see FIG. 2) of the collar 2. The collar 2 has an inner top threaded portion 2*b* (see FIG. 2) and an inner bottom non-threaded portion 2*c* (see FIG. 5).

The bracket 12 further comprises two vertical extensions 12*b* that extend downward from opposite sides of the top circumferential portion 12*a* and that end in the two bottom protrusions 12*c* that are secured to the circumferential flange 1*b* of the post 1 by bolts 13. As noted above, the bottom end 3*a* (see FIG. 2) of the barrel 3 screws into the collar 2, and the top cap 6 screws onto the top end 3*b* of the barrel 3, which is also threaded. In a preferred embodiment, the top cap 6 preferably comprises a dust seal 7 that is situated around the perimeter of the inside bore of the top cap 6. The barrel 3 preferably comprises two apertures 3*c* (see FIG. 4) that are longitudinally offset from one another. A plug 11 is shown as being inserted into the higher of the two apertures 3*c*; the purpose of the apertures 3*c* is discussed more fully in connection with FIG. 11.

Figure 2:
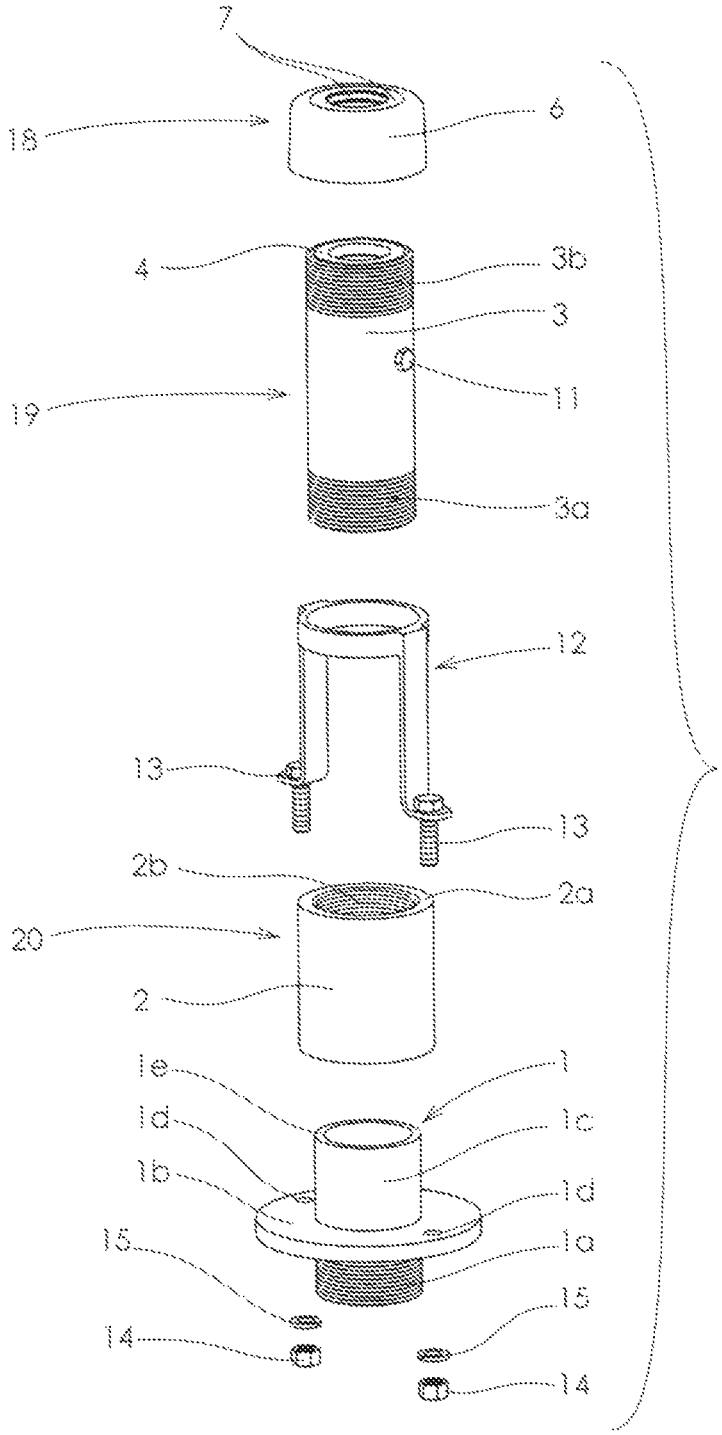
FIG. 2 is an exploded view of the present invention.

FIG. 2 is an exploded view of the present invention. In this figure, the top cap 6 and dust seal 7 are referred to as the top cap assembly 18. The barrel 3 and top and bottom bushings (only the top bushing 4 is visible in this figure) comprise the barrel assembly 19. The collar 2 and internal O-rings (not shown) comprise the collar assembly 20. These various assemblies are shown in exploded views in FIGS. 3, 4 and 5, respectively.

Figure 3:
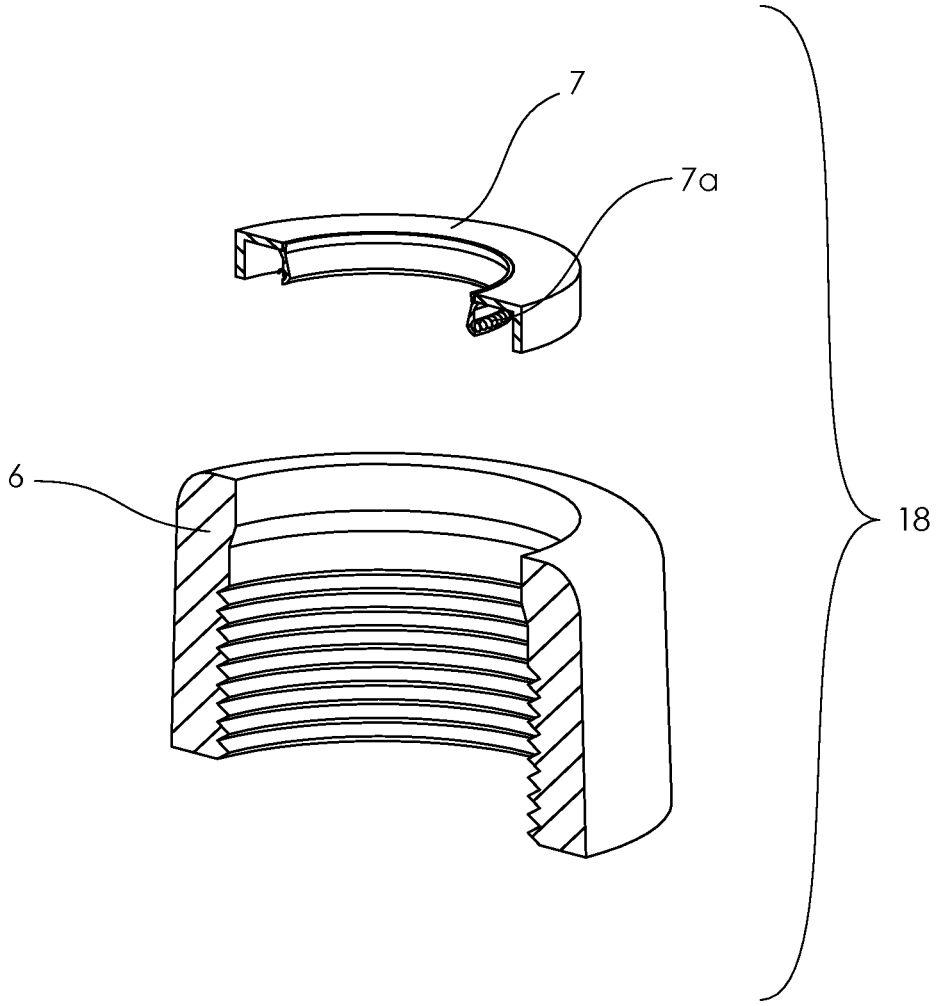
FIG. 3 is an exploded view of the top cap assembly.

FIG. 3 is an exploded view of the top cap assembly. As shown in this figure, the dust seal 7 preferably comprises a dust seal spring 7*a*. The dust seal 7 is inserted into the top part of the top cap 6.

Figure 4:
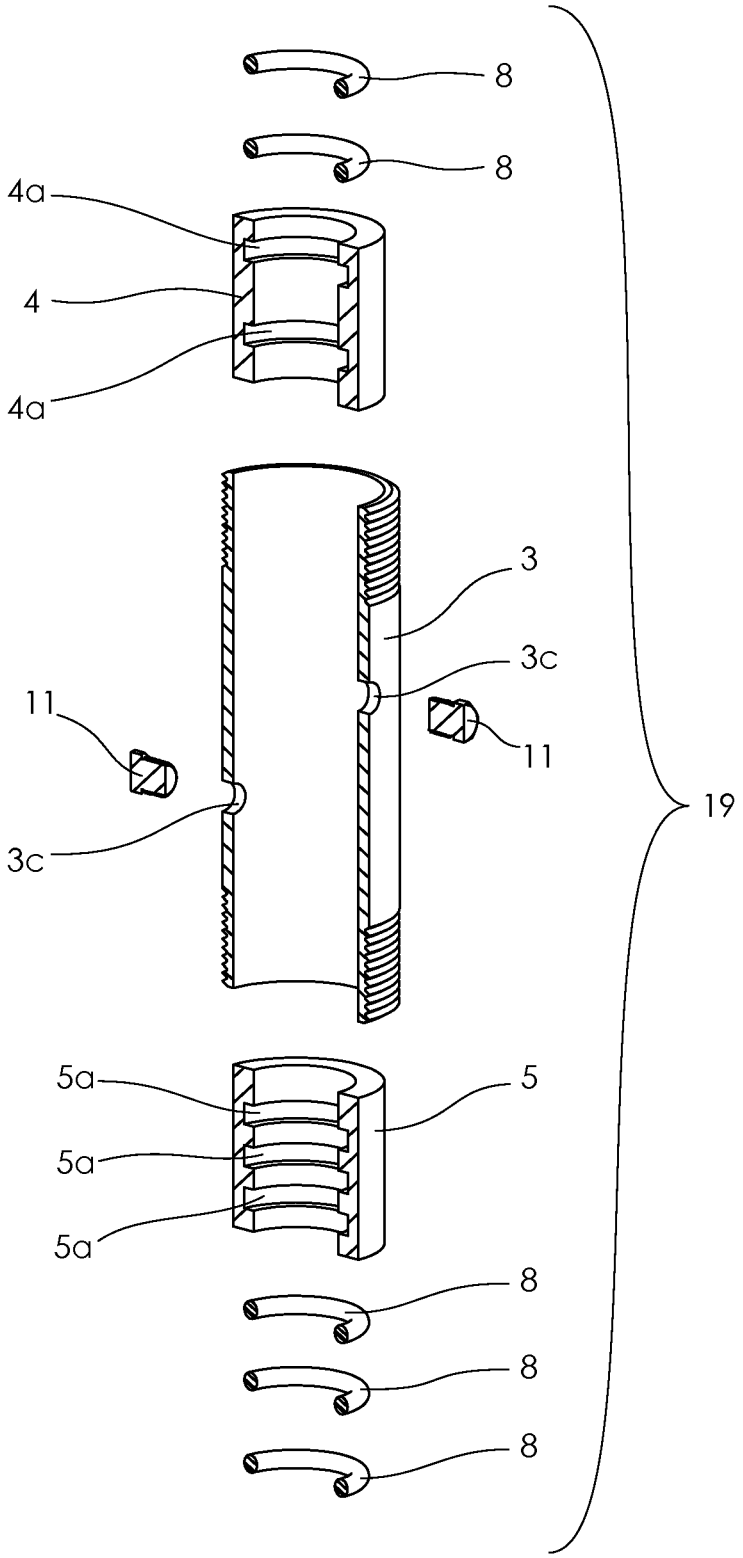
FIG. 4 is an exploded view of the barrel assembly.

FIG. 4 is an exploded view of the barrel assembly. As shown in this figure, a top bushing 4 and a bottom bushing 5 are situated inside of the barrel 3. Each of the top and bottom bushings 4, 5 comprises at least one (and preferably more than one) internal channel 4*a*, 5*a* into which an O-ring 8 is inserted. These O-rings 8 create a seal between the bushings 4, 5 and the polish rod 10 (see FIG. 8).

In a preferred embodiment, the O-rings 8 in the bottom bushing 5 are closer together and more numerous than the O-rings 8 in the top bushing 4. The O-rings 8 in the bottom bushing 5 are sealing against fluid pressure in the well, whereas the O-rings 8 in the top bushing hold oil in the fluid reservoir 21. In a preferred embodiment, the bushings 4, 5 are press fit into the barrel 3.

Figure 5:
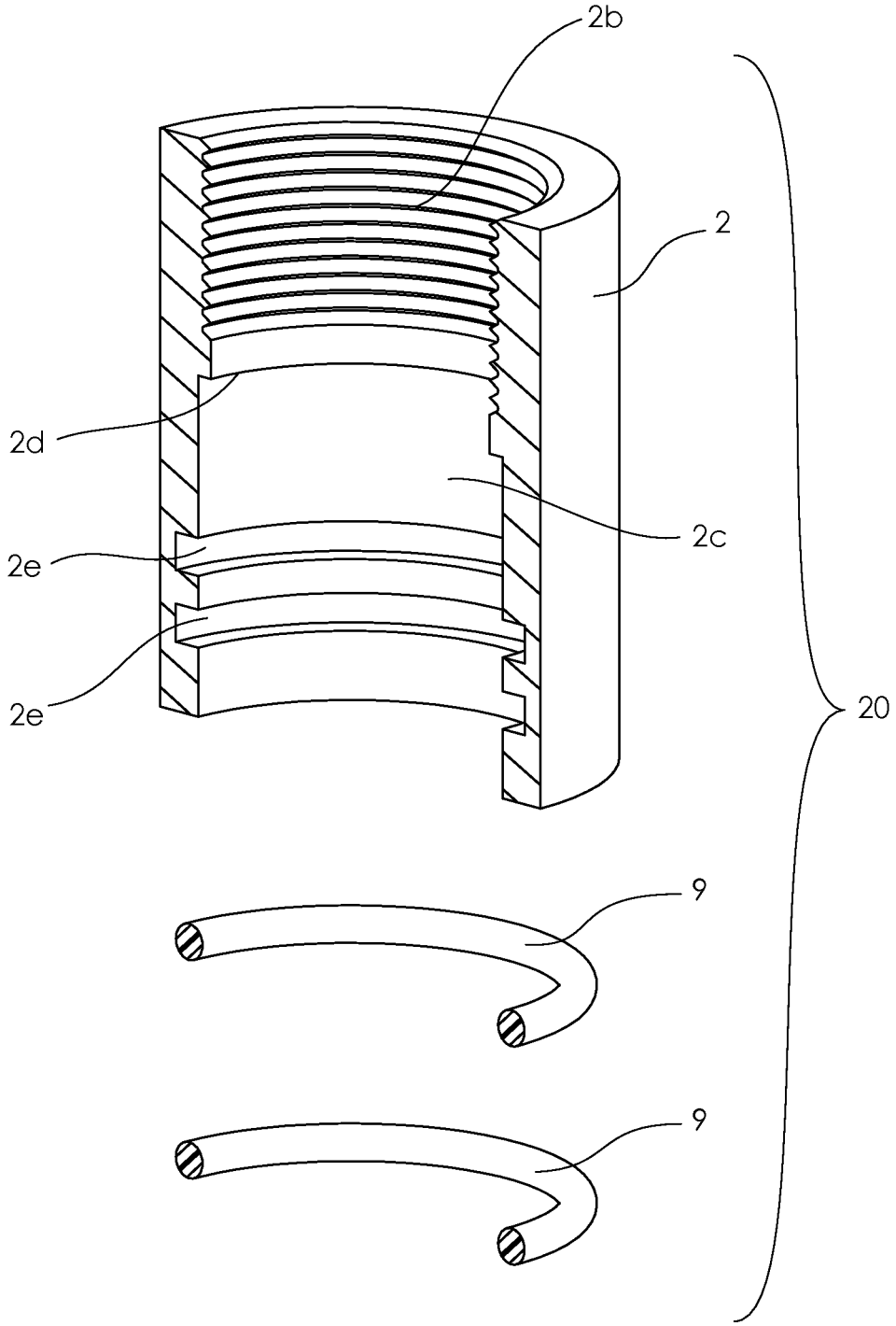
FIG. 5 is an exploded view of the collar assembly.

FIG. 5 is an exploded view of the collar assembly. As shown in this figure, the collar 2 comprises at least one and preferably more than one internal channel 2*e* into which an O-ring 9 is inserted. These O-rings 9 form a seal between the collar 2 and the top part 1*c* of the post 1.

Figure 6:
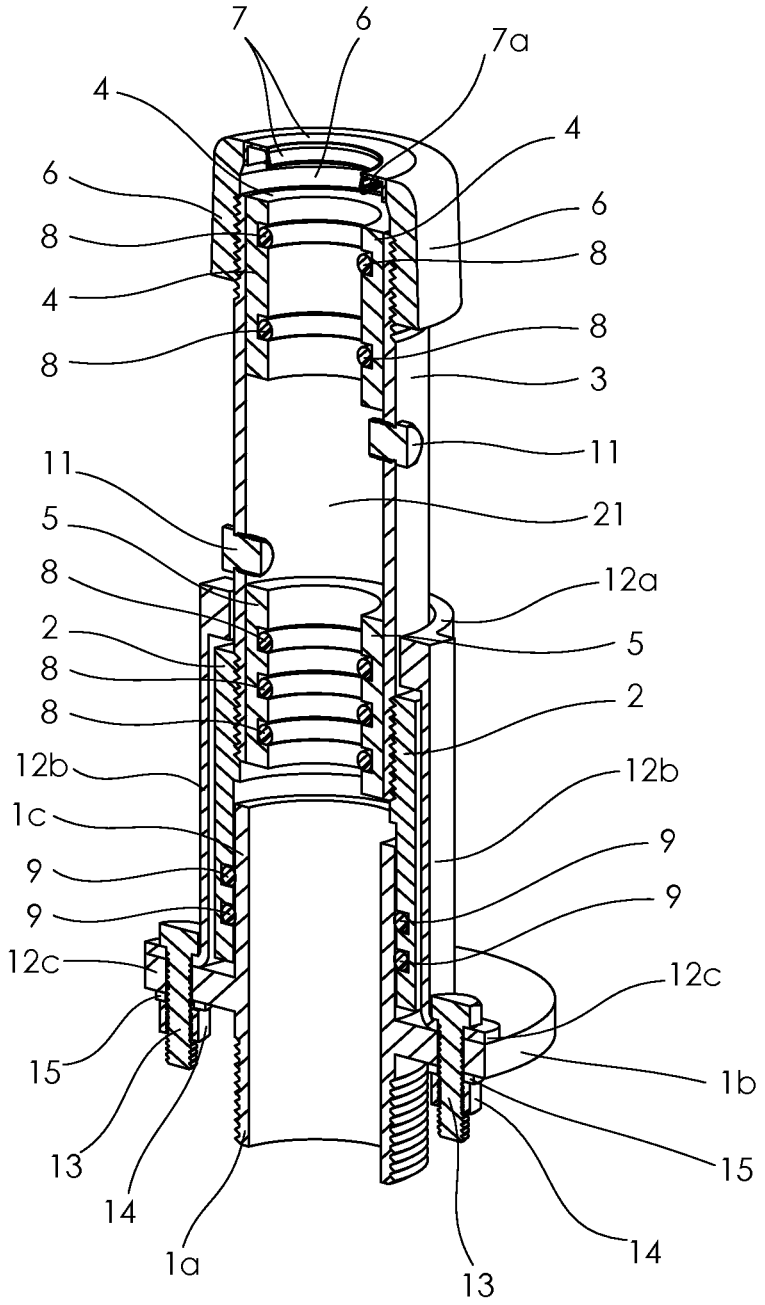
FIG. 6 is a perspective cutaway view of the present invention in the fully assembled state.

FIG. 6 is a perspective cutaway view of the present invention in the fully assembled state. As shown in this figure and described above, the O-rings 9 form a seal between the collar 2 and the top part 1*c* of the post 1. The O-rings 8 form a seal between the bushings 4, 5 and the polish rod 10 (see FIG. 8). Inside the barrel 3 and between the upper and lower bushing 4, 5 is an internal fluid reservoir 21. Note that the apertures 3*c* (shown here with plugs 11) are situated so that they open up into the internal fluid reservoir 21; in other words, they are located between the upper and lower bushings 4, 5. Note also that there is preferably a slight gap between the top surface of the circumferential flange 1*b* of the post 1 and the bottom edge of the collar 2, and there is also a slight gap between the top edge 2*a* (not labeled) of the collar 2 and the bottom edge of the top circumferential portion 12*a* of the bracket 12. These gaps enable the collar to move slightly up and down until it is seated on the post 1. Once the barrel 3 lines itself up with the polish rod 10 and the pressure of the well stabilizes, the collar 2 will rock back and forth (i.e., laterally), but it will not move up and down (i.e., longitudinally). Once the collar is seated on the post, all of the movement (flex) of the collar 2 in relation to the post 1 is in the O-rings 9.

Figure 7:
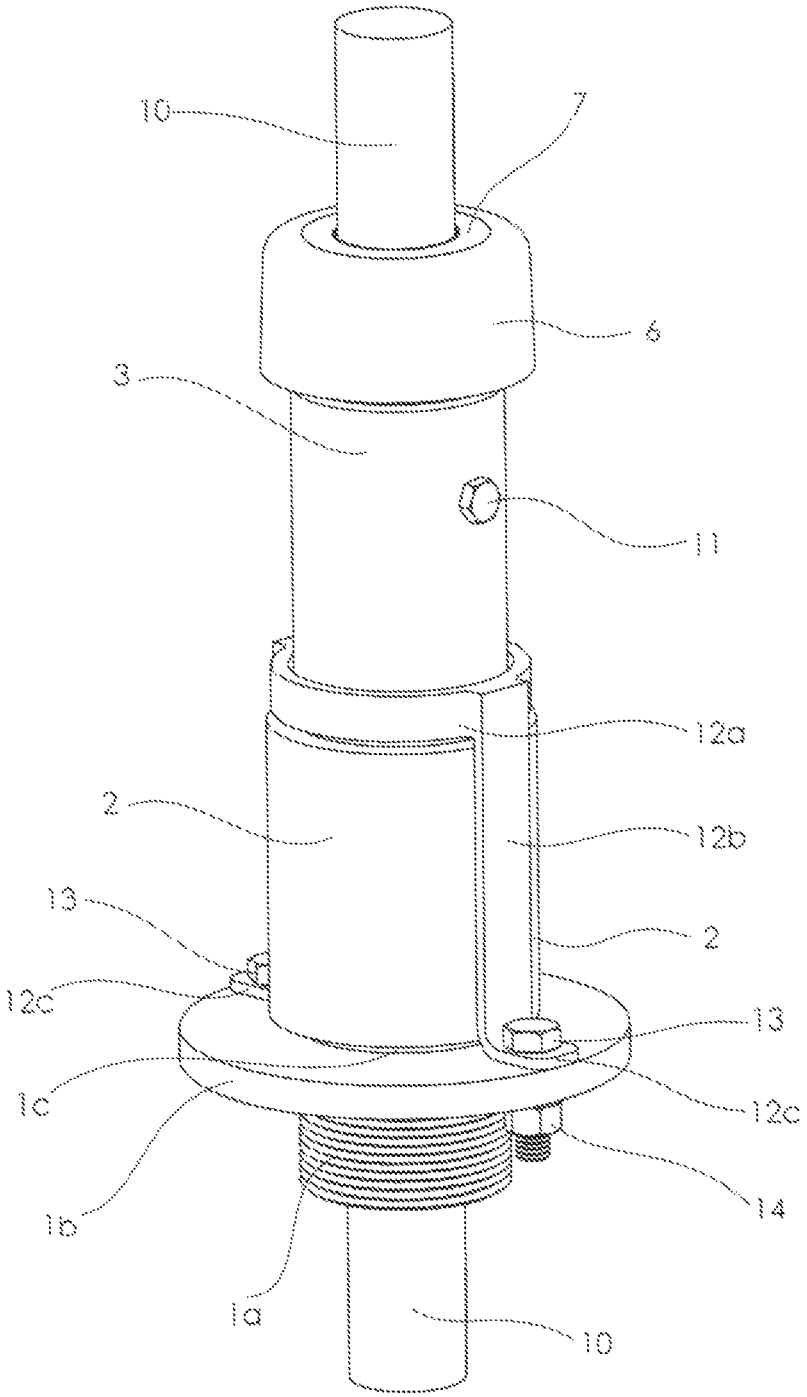
FIG. 7 is a perspective view of the present invention shown installed on a polish rod.

FIG. 7 is a perspective view of the present invention shown installed on a polish rod. As previously noted, the polish rod 10 extends through the entire invention, and the O-rings 8 in the bushings 4, 5 create a seal against the polish rod 10. No packing whatsoever is used in connection with the present invention; therefore, there is no need to replace the packing as in conventional stuffing boxes. The dust seal 7 prevents dust and debris from coming into contact with the upper bushing 4.

Figure 8:
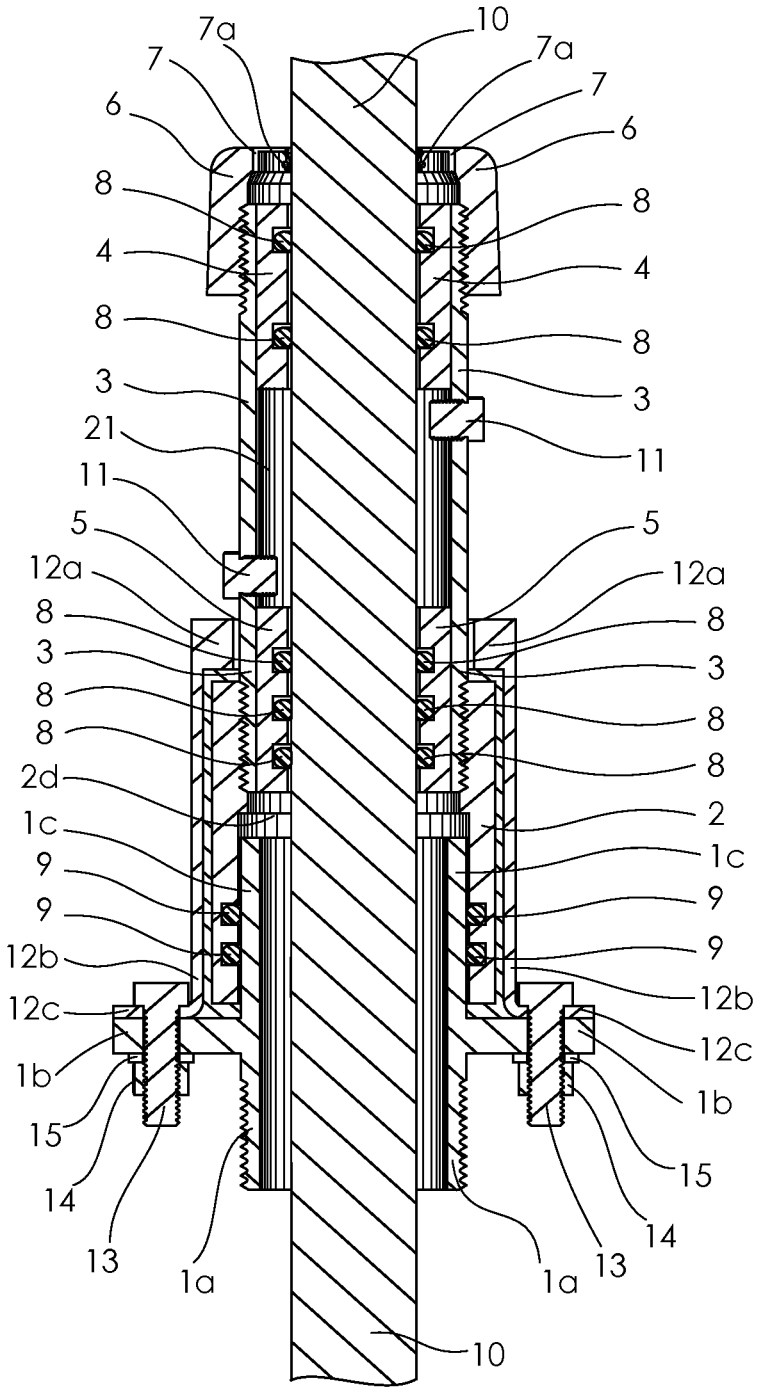
FIG. 8 is a cross-section view of the present invention in a fully assembled state.

FIG. 8 is a cross-section view of the present invention in a fully assembled state. The polish rod 10 is shown here in perfect vertical alignment; however, during operations, the polish rod will tend to vibrate or rock laterally. This movement of the polish rod is discussed more fully in connection with FIG. 9 below. Note that the outer diameter of the top part 1*c* of the post 1 and the outer diameter of the barrel 3 are roughly the same in the embodiment shown in the figures; however, the outer and inner diameter of the barrel 3 may be increased as necessary to accommodate a larger internal fluid reservoir 21.

Figure 9:
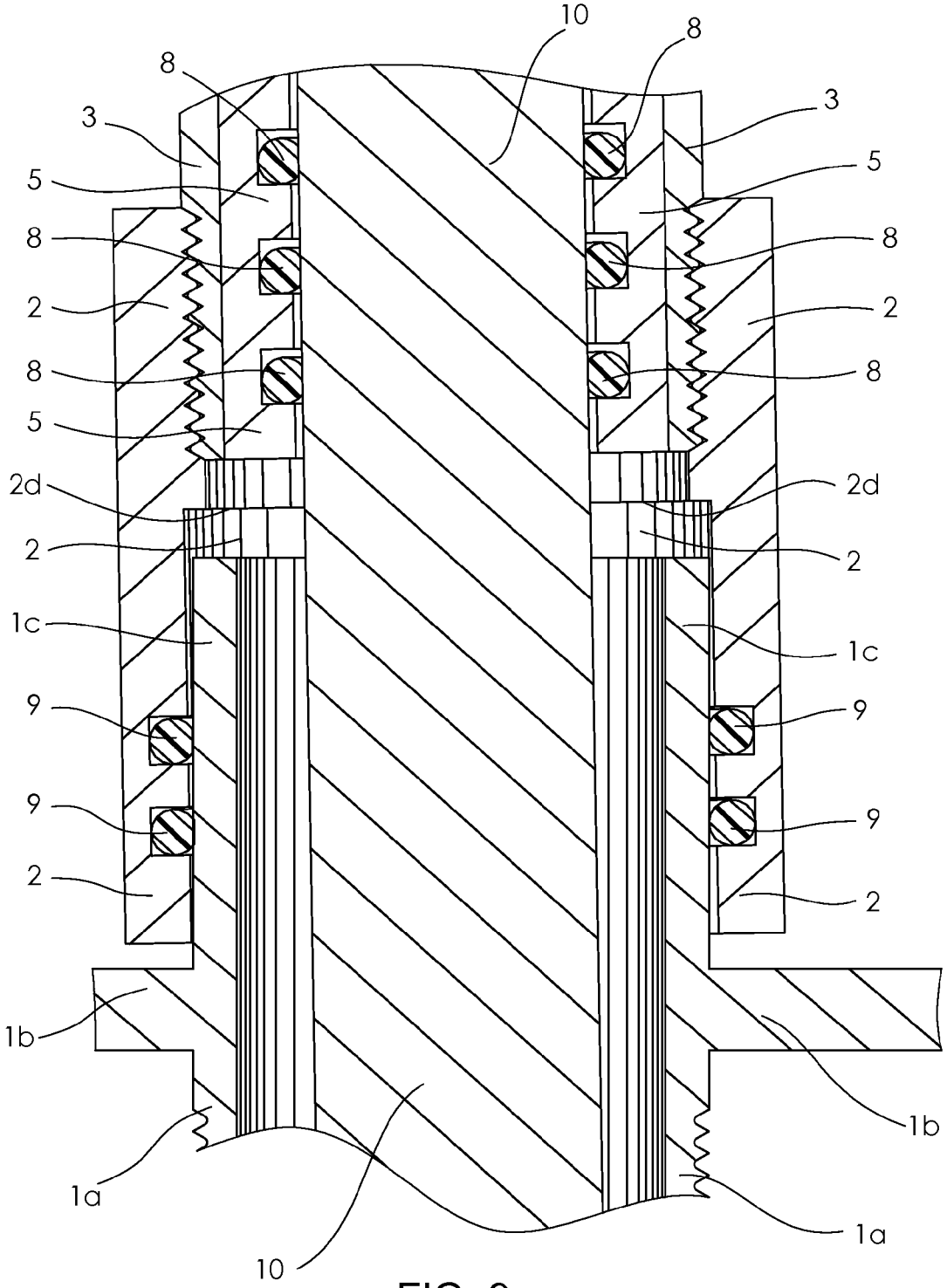
FIG. 9 is a detail view of the present invention shown with the polish rod at an angle.

FIG. 9 is a detail view of the present invention shown with the polish rod at an angle. As the polish rod 10 vibrates (or moves slightly laterally) during operation, the bushings 4, 5 and barrel 3 move with the polish rod 10. Because the barrel 3 is fixedly attached to the collar 2, the collar 2 moves with the barrel 3 and polish rod 2 as well. As shown in this figure, the flex in the invention is in the O-rings 9 inside the collar 2. In other words, as the polish rod 10 flexes, it causes the O-rings 9 to compress (or de-compress) inside the collar 2. In addition, there is some flex between the collar 2 and the post 1 (this is also shown in FIG. 9). In fact, the O-rings 8 inside of the bushings 4, 5 do not tend to wear out because most of the stress of the polish rod flexing is being taken up by the O-rings 9 in the collar 2. Even though the polish rod 10 is constantly moving up and down against the O-rings 8 inside of the bushings 4, 5, these O-rings 8 will last for years.

Figure 10:
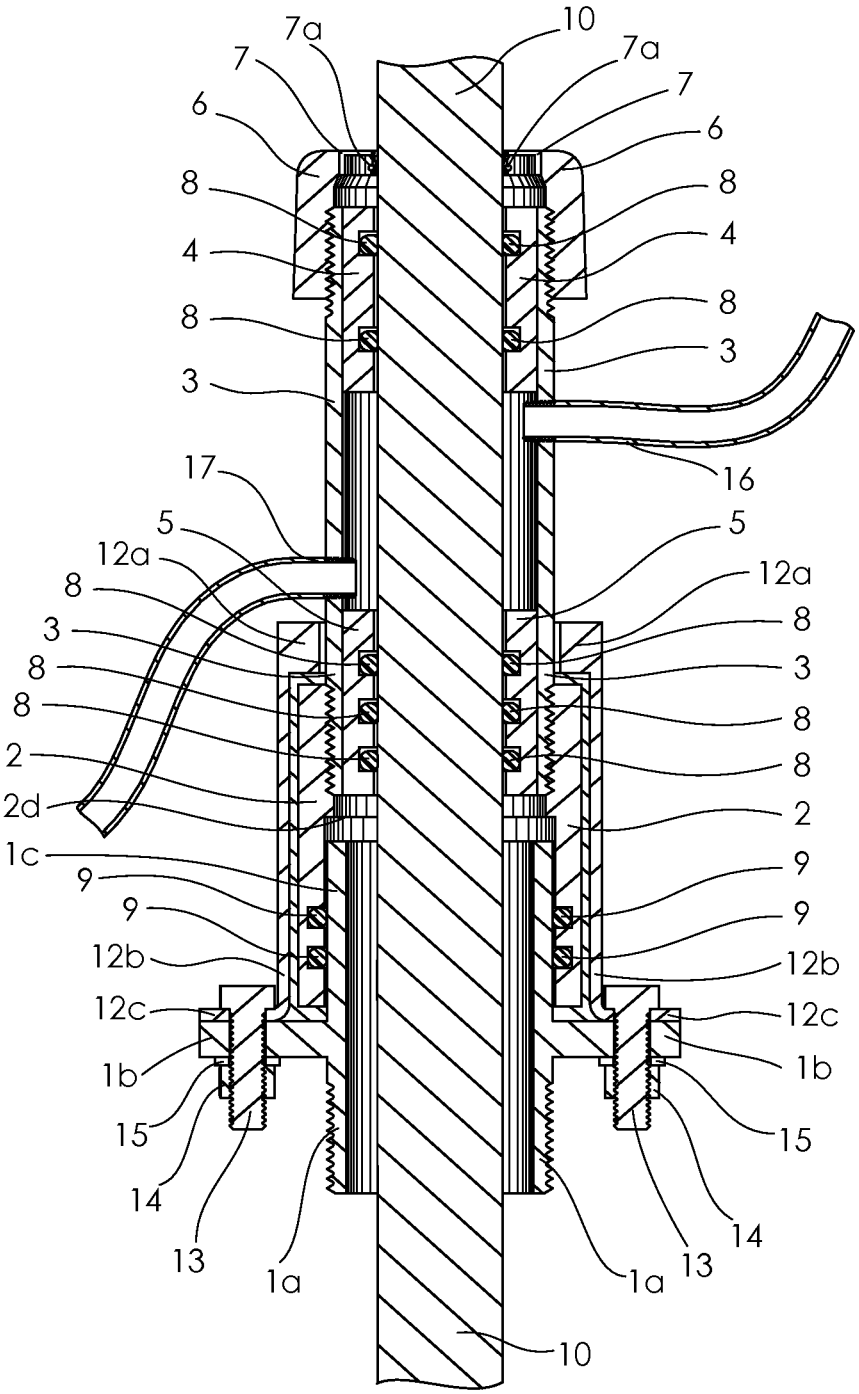
FIG. 10 is a cross-section view of the present invention shown with lubrication and drain tubes.

FIG. 10 is a cross-section view of the present invention shown with lubrication and drain tubes. The lubrication tube 16 allows oil to be gravity fed from an oil reserve tank (not shown) into the fluid reservoir 21 inside the barrel 3. The oil reserve tank preferably has a sight glass, which enables the operator to monitor the oil amount and replenish it when needed. The fluid reservoir 21 serves two purposes. First, it lubricates the polish rod 10 as it moves up and down inside of the polish rod seal, and it also lubricates the bushings 4, 5 and O-rings 8. Second, it cools the temperature of the polish rod 10 so that it does not get too hot. The drain tube 17 allows the oil in the fluid reservoir 21 to be drained (for example, to allow for periodic flushing of contaminants).

The advantages of the present invention are numerous and include, without limitation: flexibility of the barrel to maintain alignment with the polish rod; positive seal on the polish rod created by the O-rings with very little frictional surface to generate heat; constant lubrication of all components of the polish rod seal, which eliminates unnecessary wear; and relatively low cost and ease of changing the O-rings periodically, if necessary. In addition, the present invention is easily adapted to fit almost any size well tee and polish rod. Perhaps most significantly, the present invention provides environmental benefits by solving the continual problem of oil leaking from the wellhead. This ensures that the area around the well will remain free of oil contamination during routine operations.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

REFERENCES

1. Schlumberger Oilfield Glossary at: http://www.glossary.oilfield.slb.com/Display.cfm?Term=polished%20rod.

I claim:

1. A polish rod seal comprising:

(a) a post comprising a bottom end that is threaded on the outside of the bottom end only, a top part, and a circumferential flange situated between the bottom end and the top part;

(b) a collar that fits over the top part of the post, wherein the collar comprises one or more internal channels into which one or more O-rings are inserted, and wherein the O-rings are positioned between the collar and the top part of the post to form a seal between the collar and the post, the O-rings extending around an outer circumference of the post;

(c) a barrel comprising a bottom end and two internal bushings, each of which comprises one or more internal channels into which one or more O-rings are inserted; wherein the bottom end of the barrel screws into the top part of the collar;

(d) a bracket that is attached to the circumferential flange and that secures the collar on the top part of the post while still allowing it to flex on the post; and (e) top cap that screws onto a top end of the barrel;

wherein a polish rod extends through the post, the collar and the barrel and is in contact with the O-rings in the internal bushings of the barrel;

wherein the flex of the collar on the post is in the O-rings that form the seal between the collar and the post;

wherein the barrel and the top part of the post each has an outer diameter, and wherein the outer diameter of the barrel is approximately equal to the outer diameter of the top part of the post;

wherein there is a gap between a too surface of the circumferential flange and a bottom edge of the collar and a gap between a top edge of the collar and a bottom edge of a top circumferential portion of the bracket;

wherein the collar and the barrel each has a constant outside diameter and wherein the inside diameter of the collar is greater than the outside diameter of the barrel.

2. The polish rod seal of claim 1, wherein one of the two internal bushings is located in the top end of the barrel, and the other of the two internal bushings is located in the bottom end of the barrel, wherein there is a cavity between the two internal bushings inside of the barrel, and wherein this cavity acts as an internal fluid reservoir for lubricating the bushings, O-rings in the channels in the internal bushings, and polish rod and for cooling the polish rod.

3. The polish rod seal of claim 2, wherein the O-rings in the internal bushing in the bottom end of the barrel are closer together and more numerous than the O-rings in the internal bushing in the top end of the barrel.

4. The polish rod seal of claim 2, wherein the barrel comprises two apertures that are longitudinally offset from one another, and wherein one aperture acts as an inlet for adding fluid to the internal fluid reservoir, and the other aperture acts as an outlet for draining fluid in the internal fluid reservoir.

5. The polish rod seal of claim 1, wherein the top cap has an inside bore with a perimeter, and wherein the top cap comprises a dust seal that is situated around the perimeter of the inside bore of the top cap.

6. The polish rod seal of claim 1, wherein the collar comprises a top edge, and wherein the bracket comprises:

a top circumferential portion that surrounds the barrel and is situated on top of the top edge of the collar; and two vertical extensions that extend downward from opposite sides of the top circumferential portion and that end in two bottom protrusions that are secured to the circumferential flange of the post.

* * * * *